US012134832B2

(12) United States Patent
Hoelzl et al.

(10) Patent No.: US 12,134,832 B2
(45) Date of Patent: Nov. 5, 2024

(54) COATING APPARATUS FOR COATING COMPONENTS

(71) Applicant: Robert Bosch GmbH, Stuttgart (DE)

(72) Inventors: Christoph Roland Hoelzl, Kornwestheim (DE); Frank Miller, Ilsfeld (DE); Juergen Hackenberg, Sachsenheim (DE); Lutz Baumgaertner, Vaihingen an der Enz (DE); Michael Lingner, Vaihingen/Enz (DE); Tim Bergmann, Hemer (DE); Martina Bubrin, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 53 days.

(21) Appl. No.: 17/598,070

(22) PCT Filed: Mar. 18, 2020

(86) PCT No.: PCT/EP2020/057461

§ 371 (c)(1),
(2) Date: Sep. 24, 2021

(87) PCT Pub. No.: WO2020/200789

PCT Pub. Date: Oct. 8, 2020

(65) Prior Publication Data

US 2022/0220626 A1 Jul. 14, 2022

(30) Foreign Application Priority Data

Apr. 1, 2019 (DE) ..... 102019204553.7

(51) Int. Cl.
*C25D 17/06* (2006.01)
*C25D 3/12* (2006.01)
(Continued)

(52) U.S. Cl.
CPC ..... *C25D 17/005* (2013.01); *C25D 3/12* (2013.01); *C25D 5/08* (2013.01); *C25D 7/04* (2013.01); *C25D 17/06* (2013.01); *C25D 17/12* (2013.01)

(58) Field of Classification Search
None
See application file for complete search history.

(56) References Cited

U.S. PATENT DOCUMENTS 902,892 A 11/1908 Lutz
3,065,153 A 11/1962 Hough
(Continued)

FOREIGN PATENT DOCUMENTS

CA 2870682 A1 5/2015
CN 202415713 U 9/2012
(Continued)

OTHER PUBLICATIONS

English translation DE 3841215 (Year: 1989).*
(Continued)

*Primary Examiner* — Stefanie S Wittenberg
(74) *Attorney, Agent, or Firm* — NORTON ROSE FULBRIGHT US LLP; Gerard A. Messina

(57) ABSTRACT

A coating device for coating components, in particular for nickel-plating spark plug housings. The coating device includes: a housing having an outer anode that is designed to receive the component, an inner anode that can be introduced into a through-opening of the component, and a voltage-generating device, the voltage-generating device being designed to generate a first voltage between the outer anode and the component, as well as a second voltage between the inner anode and the component. The housing has an inlet and an outlet for introducing and discharging a process medium into or out of the housing.

13 Claims, 1 Drawing Sheet

(51) Int. Cl.

| | |
|---|---|
| ***C25D 5/08*** | (2006.01) |
| ***C25D 7/04*** | (2006.01) |
| ***C25D 17/00*** | (2006.01) |
| ***C25D 17/12*** | (2006.01) |

(56) References Cited

U.S. PATENT DOCUMENTS

| | | | | |
|---|---|---|---|---|
| 3,905,885 | A | 9/1975 | Bengel et al. | |
| 4,096,042 | A | 6/1978 | Looney et al. | |
| 4,497,693 | A | 2/1985 | Ogura et al. | |
| 2015/0315714 | A1* | 11/2015 | Vijay | B08B 3/024<br>204/229.4 |

FOREIGN PATENT DOCUMENTS

| | | | |
|---|---|---|---|
| EP | 019669 | A1 | 12/1980 |
| EP | 3540098 | A2 | 9/2019 |
| JP | S54151929 | U | 10/1979 |
| JP | S619691 | U | 1/1986 |
| JP | H0626585 | A | 2/1994 |
| JP | H07224396 | A | 8/1995 |
| JP | 2002097594 | A | 4/2002 |
| JP | 2014218704 | A | 11/2014 |
| JP | 2015224355 | A | 12/2015 |
| JP | 2017145438 | A | 8/2017 |
| RU | 1540336 | A1 | 4/1996 |

OTHER PUBLICATIONS

English translation JP 2015224355 (Year: 2015).*
English translation JP 2017145438 (Year: 2017).*
International Search Report for PCT/EP2020/057461, Issued Aug. 12, 2020.

* cited by examiner

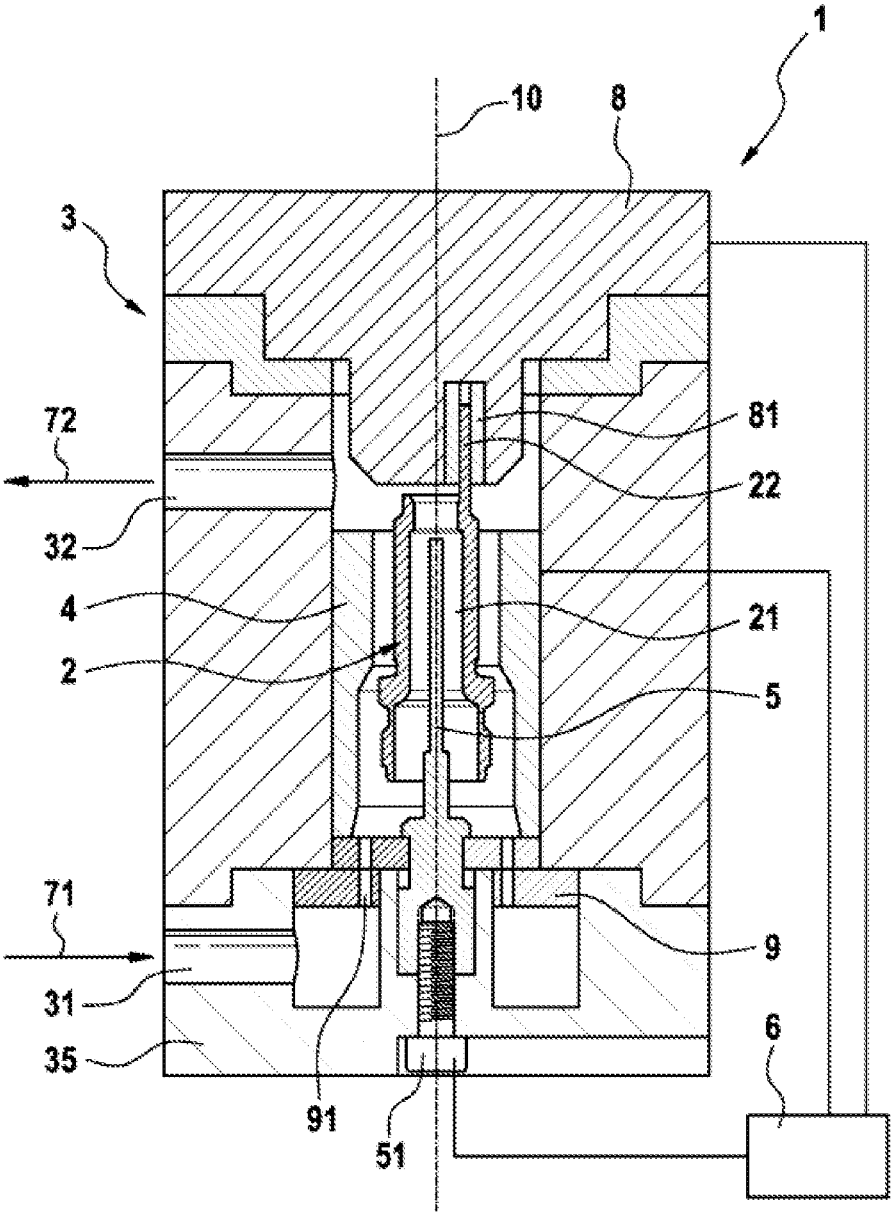
1
10
8
3
72
81
22
32
4
21
2
5
71
9
31
6
35
91
51

COATING APPARATUS FOR COATING COMPONENTS

FIELD

The present invention relates to a coating device for coating components, in particular for nickel-plating spark plug housings. In addition, the present invention relates to a coating installation.

BACKGROUND INFORMATION

The use of drum coating for the coating of components, such as spark plug housings, is conventional. Here, the components are placed into a drum as bulk goods, and the components in the drum subsequently run through all the coating steps as bulk goods.

SUMMARY

A coating device according to the present invention may offer the advantage of an improved device by which very high-quality coatings of components can be produced in a short time. According to an example embodiment of the present invention, this may be achieved by a coating device that includes a housing having an outer anode, an inner anode, and a voltage-generating device. The outer anode is thus part of the housing, and is designed to receive the component, which is preferably a spark plug housing; i.e. to grasp the component. The inner anode is capable of being introduced into a through-opening of the component. In addition, the voltage-generating device is designed to generate a first voltage between the outer anode and the component, as well as a second voltage between the inner anode and the component. Moreover, the housing has an inlet and an outlet. Through the inlet, a process medium can be introduced into the housing, and the process medium can be discharged from the housing via the outlet.

Thus, the coating device is realized in such a way that it can accept in each case exactly one component, and both an outer side and an inner side of the component can be coated, preferably nickel-plated, completely and with high quality. Due to the direct flow of the process medium around the component, a very high coating speed can be achieved, i.e., a very fast deposition of a layer on the component.

Preferred developments of the present invention are disclosed herein.

Preferably, the housing additionally includes a cover having a clamping device. The clamping device is designed to clamp the component so as to hold the component in a predefined position inside the outer anode. That is, the component is held in a defined fashion in the housing solely by the clamping device.

Particularly preferably, the component is a spark plug housing having a ground electrode. The clamping device is designed to clamp the ground electrode. There thus results a particularly simple possibility for mounting the spark plug housing inside the outer anode.

Preferably, the clamping device is designed so that it at least partly covers a surface of the ground electrode in the clamped state. In particular, in this clamped state the clamping device covers at least 80%, particularly preferably at least 95%, of the surface of the ground electrode. That is, the clamping device grasps the ground electrode of the spark plug housing in such a way that on the one hand, a defined mounting of the spark plug housing inside the outer anode is thereby enabled, and on the other hand a surface of the ground electrode is largely covered. In this way, the ground electrode is prevented from being able to come into contact with the process medium during the coating process, and is thus excluded from the coating. This is particularly advantageous if only a partial coating of the spark plug housing is intended.

In addition, it is advantageous if the process medium is a nickel electrolyte. In this way, the coating corresponds to a nickel-plating of the component, i.e. a nickel coating is produced on the component.

Preferably, the inner anode can be adjusted along a longitudinal axis of the housing in order to adapt a production of the coating to the inner side of the component. For example, in this way a different layer thickness of the coating on the inner side of the component can be achieved.

Preferably, the coating device additionally has a flow-regulating device in order to regulate a flow of the process medium through the housing. The flow-regulating device is a perforated diaphragm that is preferably rotatable. For example, such a rotatable perforated diaphragm can be provided as two discs that can be rotated relative to one another, having a plurality of through-holes. By rotating the two discs relative to one another, the overlapping of the through-holes changes, so that an overall open flow cross-section, and thus a flow through the housing, can be set.

Particularly preferably, using the flow-regulating device a first flow between the inner anode, and/or a second flow between the outer anode, and the component can respectively be regulated. Here it is particularly advantageous if the first flow and the second flow can be regulated independently of one another using the flow-regulating device in order to enable the flow of the process medium through the housing to be adapted particularly flexibly to the desired properties of the coating on both the inside and the outside of the component.

In addition, the present invention provides a coating installation that includes at least one, but preferably at least 20, and particularly preferably 48, coating devices. In addition, the coating installation includes, per coating device, at least one, preferably exactly two voltage-generating devices per coating device. In this way, a particularly efficient and rapid coating of the components in an overall installation can be achieved.

BRIEF DESCRIPTION OF THE DRAWINGS

The present invention is described on the basis of an exemplary embodiment in connection with the FIGURE. In the FIGURE, functionally identical components are provided with the same reference characters.

FIG. 1 shows a simplified schematic sectional view of a coating device according to a preferred exemplary embodiment of the present invention.

DETAILED DESCRIPTION OF EXAMPLE EMBODIMENTS

FIG. 1 shows a simplified schematic sectional view of a coating device 1 according to a preferred exemplary embodiment of the present invention. Shown here is an operating state of coating device 1 while a component 2 situated in coating device 1 is coated. Component 2 is a spark plug housing having a straight ground electrode 22.

Coating device 1 includes a housing 3 having an outer anode 4. Housing 3 extends substantially along a longitudinal axis 10. Component 2 is situated inside outer anode 4.

Outer anode 4 has an inner contour that is matched to an outer contour of component 2.

An inner anode 5 of coating device 1 is situated inside a through-opening 21 of component 2. Inner anode 5 is fastened to a floor 35 of housing 3 by a screw 51. Using screw 51, an adjustment of inner anode 5 along longitudinal axis 10 can be carried out.

In addition, housing 3 includes a cover 8 having a clamping device 81. Ground electrode 22 of component 2 is clamped in clamping device 81 in order in this way to hold component 2 in a defined position inside outer anode 4. In FIG. 1, ground electrode 22 is shown in a state in which it is not yet bent, and thus also extends in the direction of longitudinal axis 10. As can also be seen in FIG. 1, due to the clamping of ground electrode 22 in clamping device 81, more than 90% of the surface of ground electrode 22 is covered by clamping device 81, in order to prevent coating of ground electrode 22 on precisely this covered surface.

In addition, housing 3 has on floor 35 an inlet 31 via which a process medium can be introduced into housing 3 in direction 71. Moreover, in housing 3 an outlet 32 is provided via which the process medium can be discharged from housing 3 in direction 72, after it has flowed over or through component 2.

In addition, coating device 1 includes a flow-regulating device 9 that is situated at the transition between floor 35 and outer anode 4. Flow-regulating device 9 is designed as a perforated diaphragm having a plurality of holes 91 in order to regulate, by rotation, a flow, in particular a volume flow, of the process medium through housing 3.

The process medium is a nickel electrolyte by which a nickel coating can consequently be produced on component 2.

In order to produce such a nickel coating on component 2, coating device 1 has in addition a voltage-generating device 6. Using voltage-generating device 6, a first voltage can be generated between outer anode 4 and component 2. In addition, a second voltage can also be generated between inner anode 5 and component 2. In this way, by applying the first voltage and the second voltage while the process medium flows through housing 3, the nickel coating can be produced both on the inner side and on the outer side of component 2.

What is claimed is:

1. A coating device for coating a component, comprising:

a housing having an outer anode that is configured to receive the component;

an inner anode that can be introduced into a through-opening of the component; and a voltage-generating device configured to generate a first voltage between the outer anode and the component, and a second voltage between the inner anode and the component;

wherein the housing has an inlet for introducing a process medium into the housing, and an outlet for discharging the process medium from the housing, wherein the housing includes a cover having a clamping device, the clamping device being configured to clamp the component to hold the component in a predefined position inside the outer anode, wherein the component is a spark plug housing having a ground electrode, and the clamping device being configured to clamp the ground electrode, wherein the clamping device at least partly covers a surface of the ground electrode in a clamped state, and the clamping device covering at least 80% of the surface of the ground electrode in the clamped state.

2. The coating device as recited in claim 1, wherein the coating device is configured to nickel-plate the spark plug housing.

3. The coating device as recited in claim 1, wherein the clamping device covers at least 95% of the surface of the ground electrode in the clamped state.

4. The coating device as recited in claim 1, wherein the process medium is a nickel electrolyte.

5. The coating device as recited in claim 1, wherein the inner anode is adjustable along a longitudinal axis of the housing.

6. The coating device as recited in claim 1, further comprising:

a flow-regulating device configured to regulate a flow of the process medium through the housing, the flow-regulating device being a perforated diaphragm.

7. The coating device as recited in which 6, wherein the flow-regulating device is rotatable.

8. The coating device as recited in claim 6, wherein the flow-regulating device is configured to regulate, a first flow between the inner anode and the component and/or a second flow between the outer anode and the component.

9. The coating device as recited in claim 6, wherein the flow-regulating device is configured to regulate, a first flow between the inner anode and the component and a second flow between the outer anode and the component, independently of one another.

10. A coating installation, comprising:

at least one coating device for coating a component, including:

a housing having an outer anode that is configured to receive the component;

an inner anode that can be introduced into a through-opening of the component; and a voltage-generating device configured to generate a first voltage between the outer anode and the component, and a second voltage between the inner anode and the component;

wherein the housing has an inlet for introducing a process medium into the housing, and an outlet for discharging the process medium from the housing, wherein the housing includes a cover having a clamping device, the clamping device being configured to clamp the component to hold the component in a predefined position inside the outer anode, wherein the component is a spark plug housing having a ground electrode, and the clamping device being configured to clamp the ground electrode, wherein the clamping device at least partly covers a surface of the ground electrode in a clamped state, and the clamping device covering at least 80% of the surface of the ground electrode in the clamped state.

11. The coating installation as recited in claim 10, wherein the at least one coating device includes at least 20 coating devices.

12. The coating installation as recited in claim 10, wherein the at least one coating device includes at least 48 coating devices.

13. The coating installation as recited in claim 10, wherein the voltage-generating device includes at least two voltage-regulating devices for coating device.

* * * * *